US007163497B2

(12) United States Patent
Spinosa

(10) Patent No.: US 7,163,497 B2
(45) Date of Patent: Jan. 16, 2007

(54) BACKBOARD 2

(76) Inventor: Joseph Spinosa, 757 Terrace St., Honesdale, PA (US) 18431

( * ) Notice: Subject to any disclaimer, the term of this patent is extended or adjusted under 35 U.S.C. 154(b) by 31 days.

(21) Appl. No.: 11/155,854

(22) Filed: Jun. 20, 2005

(65) Prior Publication Data

US 2006/0287172 A1 Dec. 21, 2006

(51) Int. Cl.
*A63B 26/00* (2006.01)

(52) U.S. Cl. ..... 482/140; 482/142; 482/148

(58) Field of Classification Search ..... 482/140, 482/142, 148, 144–5; 5/60, 507.1; 128/25
See application file for complete search history.

(56) References Cited

U.S. PATENT DOCUMENTS 3,826,490 A * 7/1974 Mossman ..... 482/94
4,515,361 A * 5/1985 Melillo et al. ..... 482/140
4,671,257 A * 6/1987 Kaiser et al. ..... 601/34
4,780,919 A * 11/1988 Harrison ..... 5/600
4,893,812 A * 1/1990 Dawson et al. ..... 482/94
4,925,184 A * 5/1990 McJunkin et al. ..... 482/60
5,106,083 A * 4/1992 Hall ..... 482/145
5,205,804 A * 4/1993 Hall ..... 482/141
5,417,636 A * 5/1995 Havens ..... 482/145
5,820,532 A * 10/1998 Oliver ..... 482/123
6,282,734 B1 * 9/2001 Holberg ..... 5/81.1 HS
6,321,398 B1 * 11/2001 Wang ..... 5/81.1 R
6,890,289 B1 * 5/2005 Spinosa ..... 482/140

* cited by examiner

*Primary Examiner*—Lori Amerson

(57) ABSTRACT

The device is designed to enable the user to perform both abdominal strengthening and back muscle strengthening exercises on the top surface of a conventional bed. A conventional bed is defined as one with a semi-rigid mattress and a rigid frame.

The device attaches and detaches to the said bed easily and provides the means to strengthen both the flexor and extensor muscles of the trunk with the added advantages of convenience and low cost. The device is a departure from the previous art as detailed in U.S. Pat. No. 6,890,289 Spinosa, May 10, 2005, in that it provides increased stability for both the bed and the user in the performance of said exercises.

1 Claim, 5 Drawing Sheets

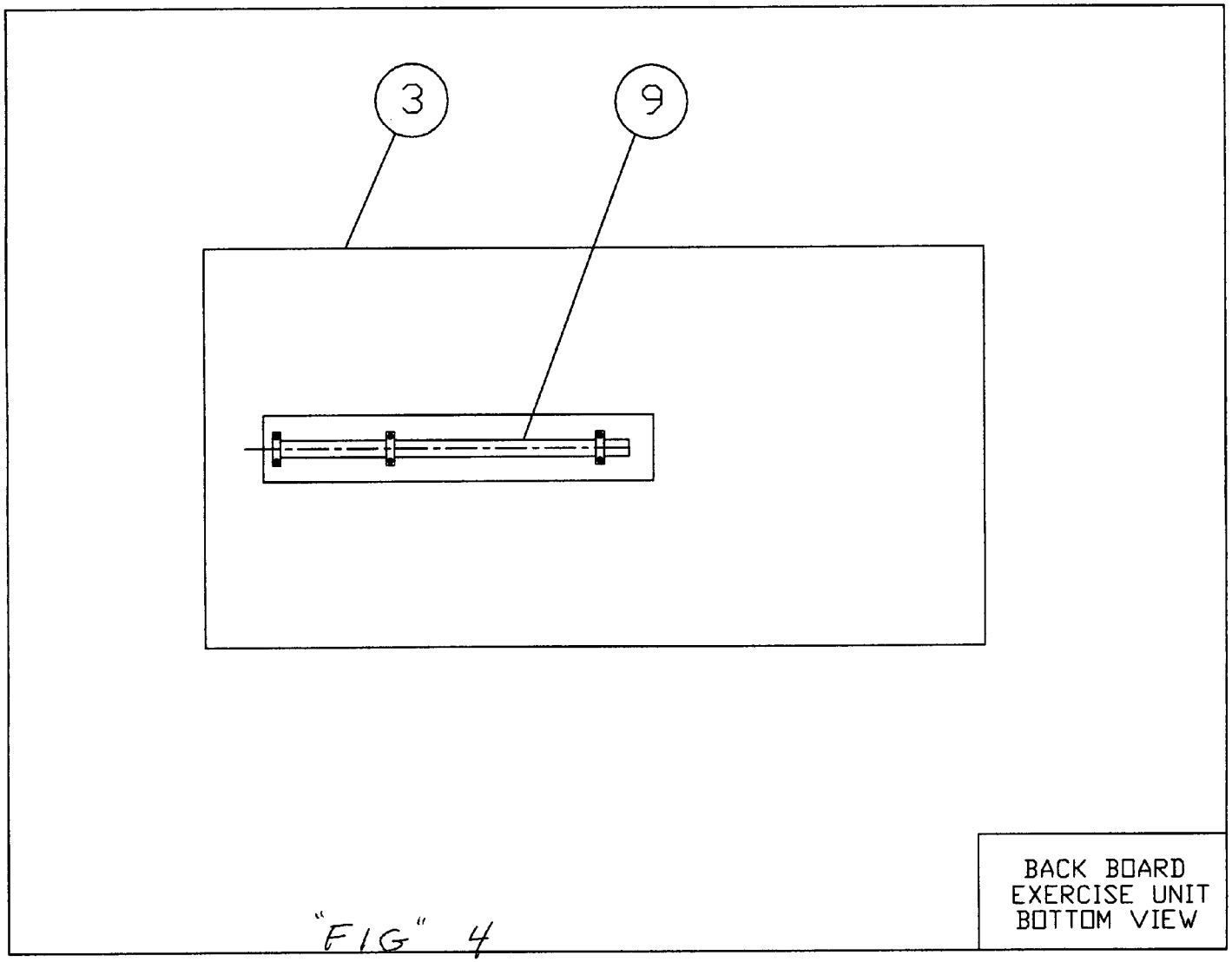
"FIG" 4

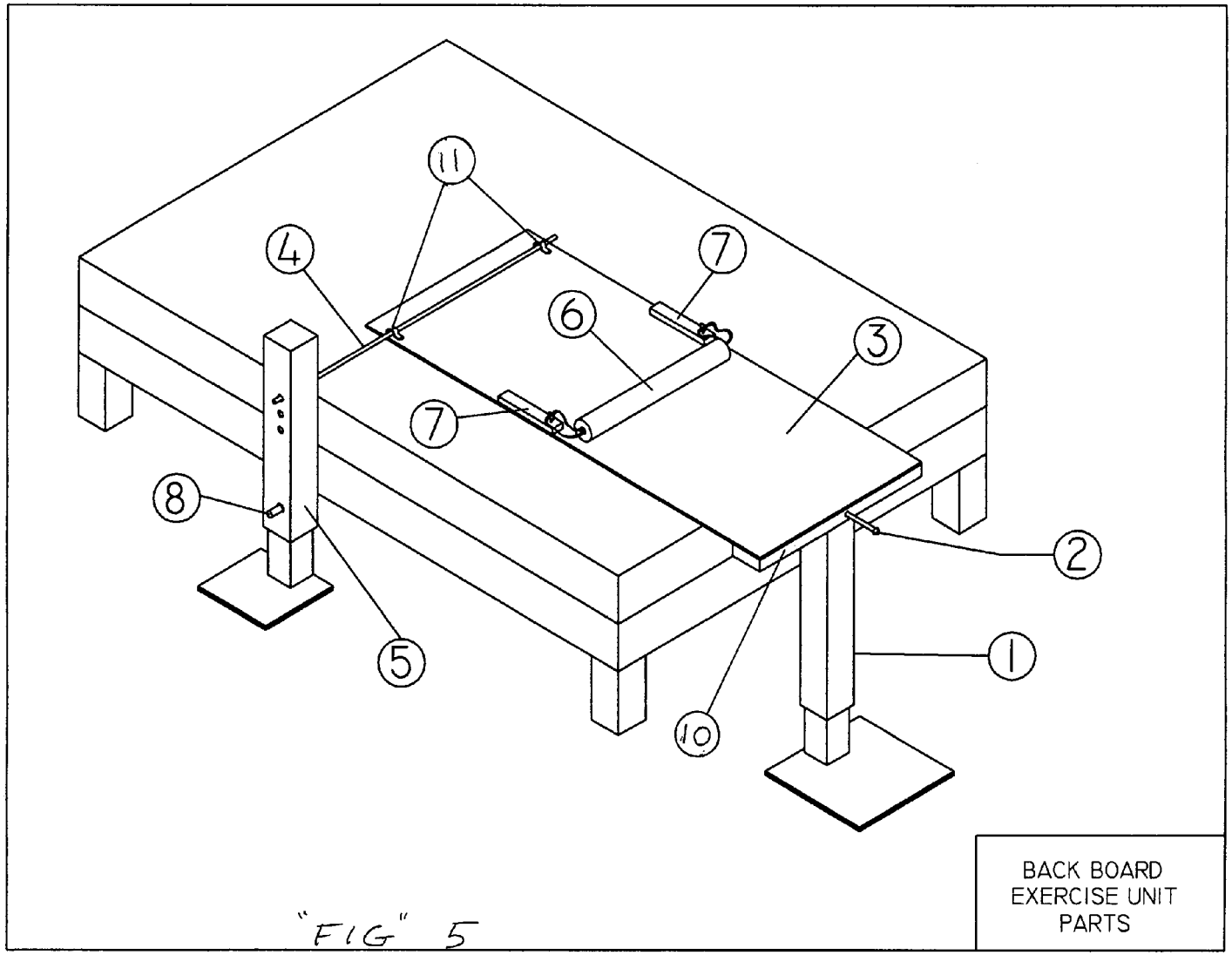
"FIG" 5

BACKBOARD 2

CROSS REFERENCES TO RELATED APPLICATIONS

| | | | | |
|---|---|---|---|---|
| 1. | 5106083 | Dec. 10, 1990 | Hall | 482/145 |
| 2. | 4830367 | May 16, 1989 | Foran | 482/140 |
| 3. | 4609193 | Sep. 2, 1986 | Paris | 482/144 |
| 4. | 4522391 | Jun. 11, 1985 | Rundall | 482/40 |
| 5. | 4182511 | Jan. 8, 1980 | Camp | 482/142 |
| 6. | 6231923 | Apr. 10, 2001 | Cameron | 482/142 |
| 7. | 5776042 | Jul, 7, 1998 | Szabo | 482/140 |
| 8. | 5871425 | Feb. 16, 1999 | Gvoich | 482/140 |
| 9. | 6213923 | Mar. 1, 1999 | Cameron | 482/140 |
| 10. | 5492520 | Feb. 1, 1996 | Brown | 482/142 |
| 11. | 5725463 | Mar.1, 1998 | Colonello | 482/140 |
| 12. | 5776042 | Jul. 7, 1998 | Szabo | 482/140 |
| 13. | 1705745 | Mar. 1, 1929 | Anderson | 482/133 |
| 14. | 4893813 | Jan. 16 1990 | Murray | 482/145 |
| 15. | 5256126 | Oct. 1, 1993 | Grotstein | 482/133 |
| 16. | 5346447 | Sep. 1, 1994 | Stearns | 482/140 |
| 17. | 5441473 | Aug. 1, 1995 | Safani | 482/140 |
| 18. | 4319747 | Mar. 1, 1982 | Rogers | 482/145 |
| 19. | 6890289 | May 19, 2005 | Spinosa | 482/140 |
| 20. | 3826490 | July 1974 | Mossman | |
| 21. | 4515361 | May 1985 | Melillo et al | |
| 22. | 4671257 | June 1987 | Kaiser et al | |
| 23. | 4780919 | November 1988 | Hamson | |
| 24. | 4893812 | January 1990 | Dawson et al | |
| 25. | 4925184 | May 1990 | McJunkin et al | |
| 26. | 5106083 | April 1992 | Hall | |
| 27. | 5205804 | April 1993 | Hall | |
| 28. | 5417636 | May 1995 | Havens | |
| 30. | 5539741 | July 1996 | Barraclough et al | |
| 31. | 5820532 | October 1998 | Oliver | |
| 32. | 6282734 | September 2001 | Holberg | |
| 33. | 6321398 | November 2001 | Wang | |
| 34. | 2002/0133878 | September 2002 | O'Connell | |

BACKGROUND OF THE INVENTION

Acute low back problems are experienced by a large percentage of the adult population in the United States. The costs in terms of medical treatment, time lost from work, and disruption of normal activities are significant. The invention is offered as a means to prevent acute low back pain as defined by activity intolerance of less than three months duration in the absence of serious spinal pathology. The invention provides the means to strengthen the trunk muscles in the home setting at low cost and maximum convenience.

According to the U.S. Department of Health and Human Services, "Conditioning exercises for the trunk muscles (particularly the back extensors) may be helpful, especially if the patient's acute low back problems persist". The latter quote is found on page 3 of the AHCPR (Agency for Health Care Policy and Research) publication No. 95-0642 December 1994.

Exercise devices for trunk strengthening have been offered in the past, but they tend to be expensive and inconvenient to use at home. Since trunk strengthening must be done regularly throughout the active years of the life span, the methodology must maximize efficiency and convenience.

The device, Backboard 2, is a departure from the previous art as detailed in U.S. Pat. No. 6,890,289 Spinosa, May 10, 2005, in that it provides increased stability for both the bed and the user in the performance of said exercises.

BRIEF SUMMARY OF THE INVENTION

The invention consists of a rectangular board and two freestanding upright support posts. The board is mounted on a bed and serves as the platform from which exercises are performed. The support posts serve to provide stability to the board and to provide a means to attach the board to the bed.

Together, the invention and bed become a trunk strengthening device. The board and the two support posts are easily assembled and disassembled and require minimal space for storage when not in use.

The first support post mounts at the first end of the rectangular board and provides both support to the first end of the board and stability to the bed as exercises are performed. The second support post attaches to the first side of the board and secures the rectangular board to the bed so that it can not move either vertically or horizontally as exercises are performed.

The addition of the first supporting post represents a departure from the previous art as detailed in reference U.S. Pat. No. 6,890,289, Spinosa, May 10, 2005. The first supporting post enables users of greater height and weight to exercise on the board while providing increased stability to both bed and board.

As the two supporting posts and the rectangular board are connected together and attached to the bed, both trunk flexion and trunk extension exercises can be performed by users of various height and weight.

DETAILED DESCRIPTION OF THE INVENTION

The invention consists of a rectangular board and two attachable upright support posts. The board which is rigid and light weight is mounted on a bed and serves as the platform from which exercises are performed. The board has a foam covered bar which serves to stabilize the lower extremities of the user as exercises are performed. The foam covered bar is adjustable in both the vertical and horizontal directions in order to accommodate users of various size. The rectangular board has two guide clamps on its top surface and a guide sleeve on its bottom surface.

The first support post has a rectangular base and a horizontal beam at its upper end. The first support post is positioned under the edge of the rectangular board at the foot of the bed. The horizontal beam has an aperture through which a first metal rod is passed in to the guide sleeve at the bottom of the rectangular board. The first metal rod serves to connect the first support post to the rectangular board. The first support post is adjustable in height to accommodate beds of various height.

The second support post has a rectangular base, is adjustable in height, and has two sets of apertures. The second support post is positioned at the side of the bed and is connected to the rectangular board at its first side by means of a second metal rod which passes through the upper aperture of the second post and through the guide clamps on the top of the board. A third metal rod is shorter and passes through the lower aperture of the second post and passes under the bed in close proximity to its frame.

The rectangular board is positioned with its first end near the edge of the foot of the bed. The support posts are then connected to the board. The first supporting post is a departure from the prior art. The first post provides increased stability for both the bed and the board for tall and heavy users.

To perform abdominal exercise, the user lies on the board in the supine position with the hips and knees flexed and the feet secured under the foam bar. Sit ups and abdominal curls are performed in the usual manner.

To perform back strengthening exercise, the user lies in a prone position on the top of the board with the waist at the first end of the board which is over the edge of the foot of the bed. The ankles are positioned under the foam covered bar in order to stabilize the lower trunk and the lower extremities. The user allows the upper body to flex forward over the edge of the bed. Back strengthening is accomplished by returning the upper body to the horizontal position from the downward flexed position repeatedly until muscle fatigue is accomplished.

Five pages of drawings are submitted with details of the invention contained and numbered in the following legend.

Legend:

1. supporting post named in the claims as the second part which includes a horizontal top beam and a rectangular base
2. First metal rod
3. Rectangular board
4. Second metal rod
5. Supporting post named in the claims as the third part which includes a rectangular base and two sets of apertures for the second and third metal rod
6. Foam covered bar
7. adjustable attachment of foam covered bar to rectangular board
8. Third metal rod
9. guide sleeve for first metal rod
10. horizontal top beam
11. guide clamps

BRIEF DESCRIPTION OF THE DRAWINGS

FIG. 4 Shows the guide sleeve that is mounted on the bottom of the board at its first end.

FIG. 5 Show the three parts as they are attached together and positioned on a bed.

Figure 1:
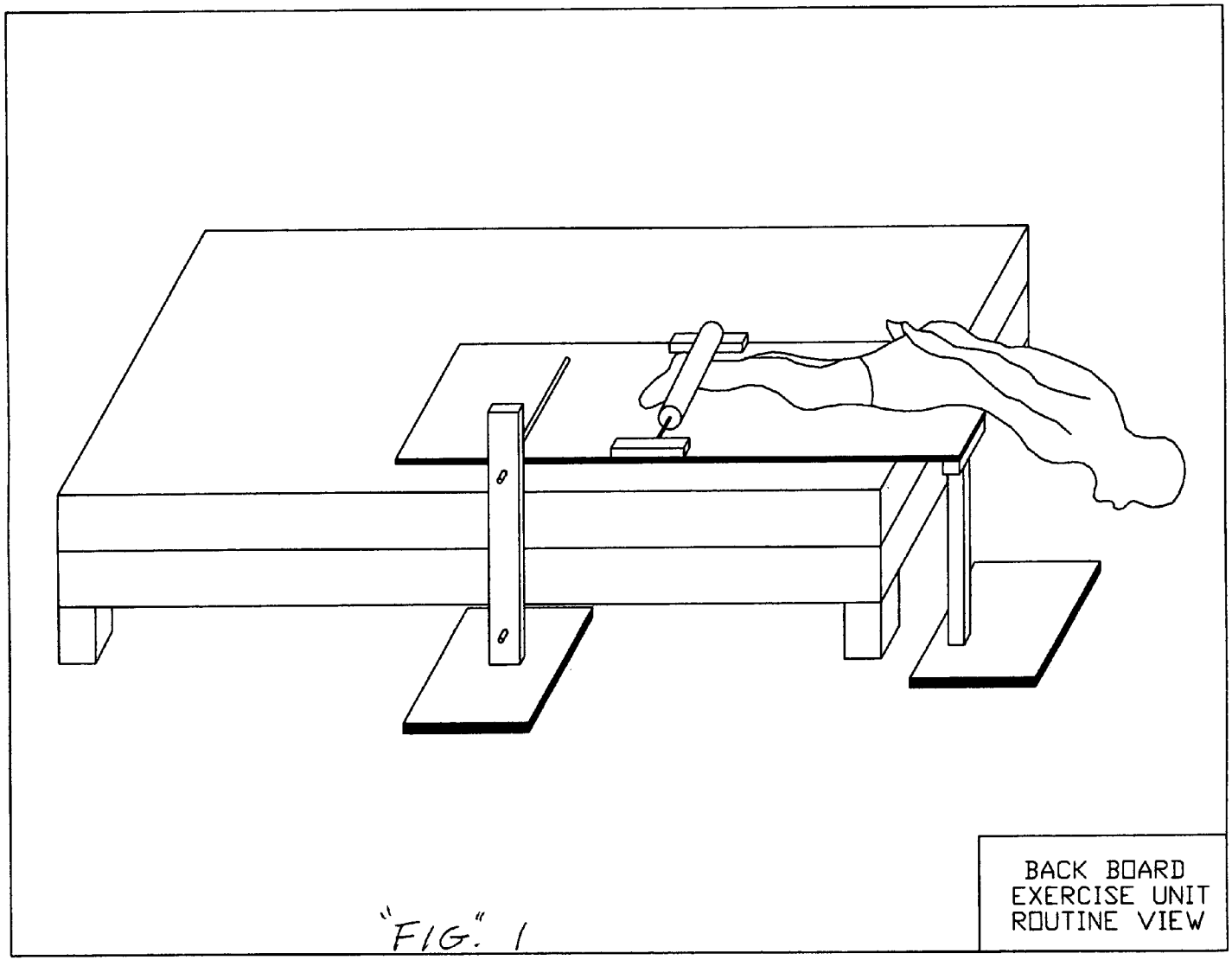
FIG. 1. Demonstrates how back extension exercises are performed. The user is in the prone position with the lower extremities retained under the foam covered bar. The user's waist is at the edge of the board at its first end.
Figure 2:
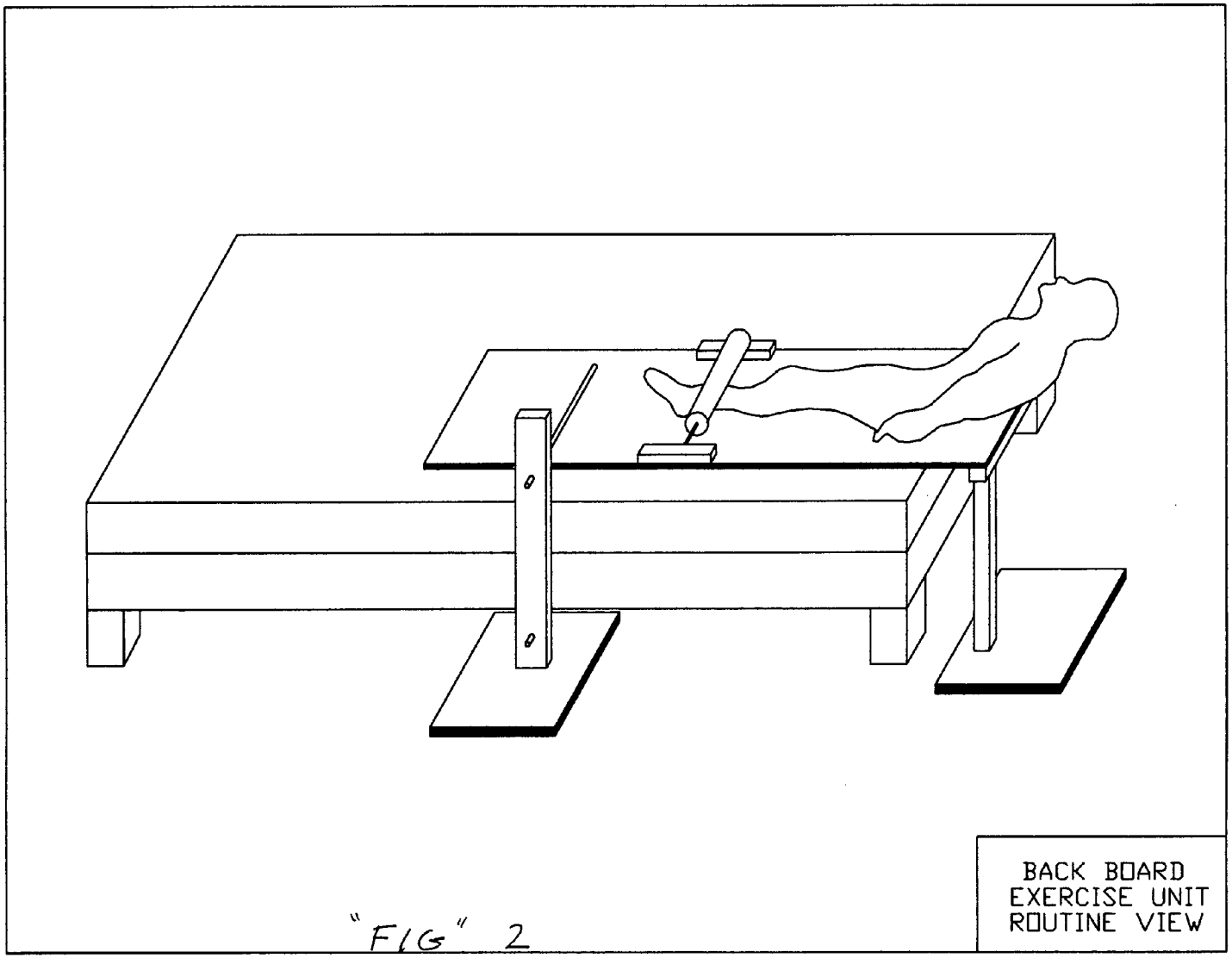
FIG. 2 Demonstrates how abdominal strengthening exercises are performed. The user is in the supine position with the lower extremities retained under the foam covered bar.
Figure 3:
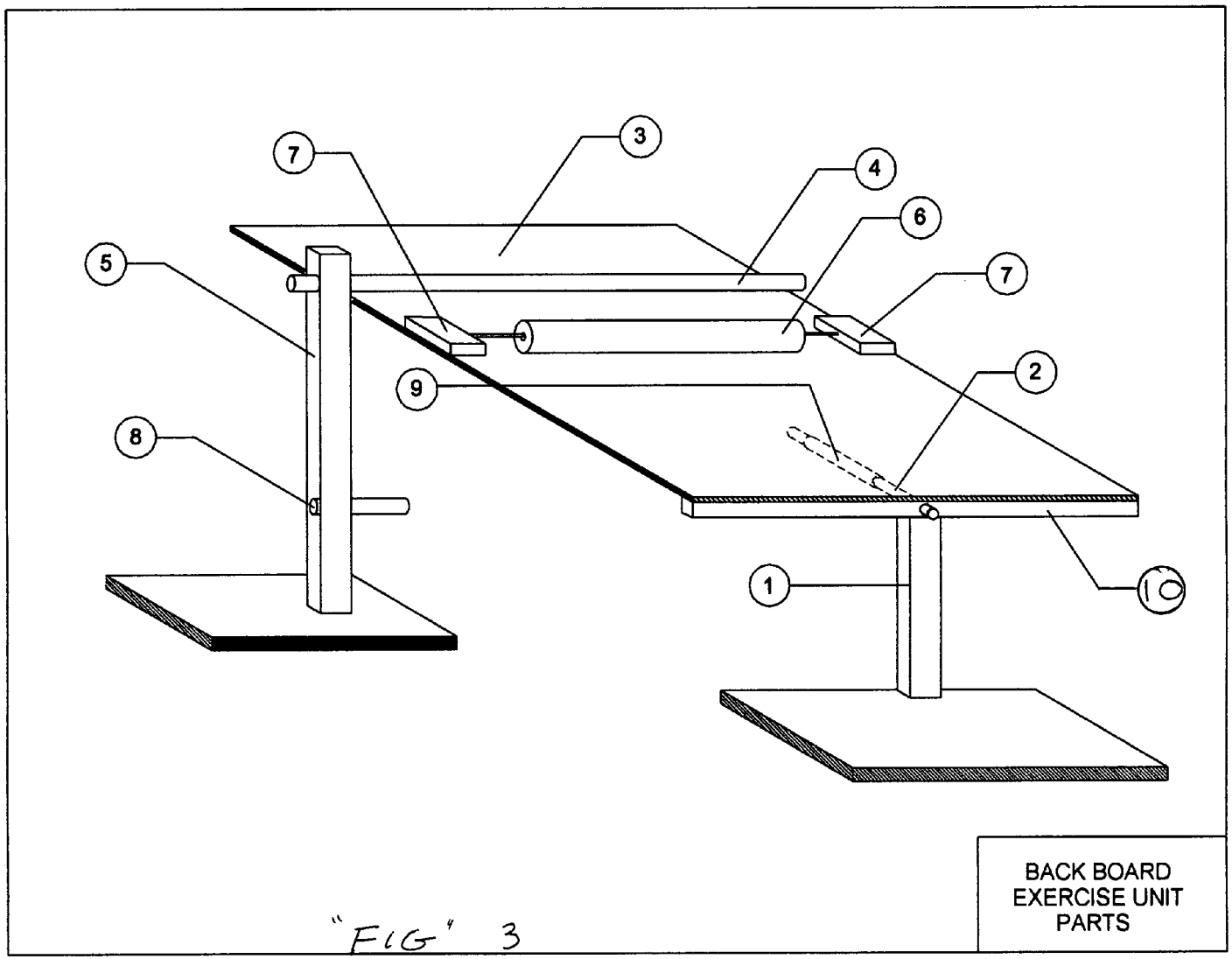
FIG. 3 Demonstrates how the three parts are oriented and attached to each other.

I claim:

1. An exercise device attached to a conventional bed for exercising the trunk flexor and trunk extensor muscles, said device essentially consisting of:

A first, second, and third attachable part, said first part including a rigid rectangular board with a first and second end, a first and second side, and a top and bottom designed and configured to support the lower trunk of a user; said board positioned on a top surface of said bed;

Said second end of said board having a foam covered bar being adjustable both horizontally and vertically relative to said board for stabilizing the lower extremities of a user; Said top surface of said second end of said board having mounted thereon two guide clamps; Said bottom surface of said first end of said board having mounted thereon one guide sleeve;

Said second part for stabilization of said rectangular board in both horizontal and vertical directions including a vertically adjustable post mounted on a rectangular base having a horizontal top beam; said top beam having an aperture for a first metal rod which passes through it and into said guide sleeve of said board;

Said third part for stabilizing and aligning said board to said bed in a horizontal and vertical direction including a vertically adjustable post mounted on a rectangular base; said post having two sets of apertures for each of two metal rods; said rods being an upper second rod and a bottom third rod which pass through said apertures; said bottom third rod defined by a shorter length than said upper second rod; said bottom rod extending horizontally underneath said bed while said upper rod extending horizontally over a top surface of said rectangular board and through said guide clamps.

* * * * *